US007896346B2

(12) United States Patent
O'Donnell

(10) Patent No.: US 7,896,346 B2
(45) Date of Patent: Mar. 1, 2011

(54) EUCHRE SCORE AND TRUMP IDENTIFIER

(76) Inventor: Patrick G. O'Donnell, Northville, MI (US)

( * ) Notice: Subject to any disclaimer, the term of this patent is extended or adjusted under 35 U.S.C. 154(b) by 73 days.

(21) Appl. No.: 12/509,921

(22) Filed: Jul. 27, 2009

(65) Prior Publication Data

US 2010/0019448 A1 Jan. 28, 2010

Related U.S. Application Data

(60) Provisional application No. 61/083,978, filed on Jul. 28, 2008.

(51) Int. Cl.
*A63F 1/18* (2006.01)
*A63F 1/10* (2006.01)

(52) U.S. Cl. ..... 273/148 A; 273/148 R

(58) Field of Classification Search ..... 273/148 A, 273/148 R

See application file for complete search history.

(56) References Cited

U.S. PATENT DOCUMENTS

| | | | | |
|---|---|---|---|---|
| 128,910 A | | 7/1872 | Richardson | |
| 439,450 A | | 10/1890 | Ward | |
| 446,701 A | | 2/1891 | Zimmerling | |
| 648,800 A | | 5/1900 | Schlief | |
| 710,993 A | * | 10/1902 | Norrington | 273/148 A |
| 766,545 A | * | 8/1904 | Sterl | 273/148 A |
| 1,209,542 A | | 12/1916 | Best | |
| 1,486,313 A | * | 3/1924 | Van Antwerp | 235/87 R |
| 1,683,242 A | * | 9/1928 | Deister, Jr. | 40/334 |
| 1,734,650 A | * | 11/1929 | Solinger | 40/334 |
| 3,467,382 A | | 9/1969 | Leadley | |
| D217,171 S | | 4/1970 | Copeland | |
| 5,491,324 A | | 2/1996 | Vanderpool | |
| D489,418 S | | 5/2004 | Helton, Sr. | |

* cited by examiner

*Primary Examiner*—Benjamin H Layno
(74) *Attorney, Agent, or Firm*—Steve Clemmons

(57) ABSTRACT

A combination euchre score and trump indicating device. The system includes a pair of scoring dials that are mounted to the interior face of a pair of end caps. The end caps removably mate with a body. The body is generally cube-shaped having four flat outer surfaces. Each outer surface prominently bears one of the four trump suits. When the end caps are coupled to the body, the interior faces and scoring dials are hidden by the body, protecting the scoring dials from damage and fully enclosing an internal storage compartment.

16 Claims, 3 Drawing Sheets

EUCHRE SCORE AND TRUMP IDENTIFIER

CROSS-REFERENCE TO RELATED APPLICATION

This application claims priority of U.S. Provisional Patent Application filed Jul. 28, 2008 having Ser. No. 61/083,978.

FIELD OF THE INVENTION

The present invention is related to game scoring signals or indicators and, more particularly, to a euchre score indicator.

BACKGROUND OF THE INVENTION

Euchre is a game played using conventional playing cards. Each game is traditionally played to a score of ten, requiring players to keep track of the score during play and is updated after each hand. Furthermore, one suit is selected as trump for each hand requiring the players to remember which suit is trump for each hand.

While it is usually not necessary to remind players what suit is designated trump for a given hand, there are often times during play when a player forgets, does not hear, or was not paying attention while trump was designated. To speed play and avoid both embarrassment to the heedless player and upsetting the other players, it is desirable to provide a visual marker showing all players the current trump suit.

SUMMARY OF THE INVENTION

The broad purpose of the present invention is to provide a combination score and trump indicating device for the game of euchre. The device includes a pair of scoring indicators and a central body having trump identifiers around its outer surfaces. The scoring indicators and body are configured such that the two scoring indicators can be removably coupled to the body. The body has a generally tubular shape and the scoring indicators are removably mounted to cap the open ends of the tubular body.

It is an advantage of the present invention that when the scoring indicators are in the stowed position, the scoring indicators and walls of the body define and enclose a storage compartment within the tubular body.

It is another advantage of the present invention that the means for displaying the score is mounted to a portion of the scoring indicator that is covered and protected by the body when the scoring indicator is placed in the stowed position.

It is still another advantage of the present invention that when the scoring indicators are coupled to the body in a stowed position, the outer surfaces of the body and scoring indicators present a substantially smooth, solid, and cube-like shape.

It is yet another advantage of the present invention to provide a combination euchre score and trump indicating device. The device comprising a tubular body having four distinct outer walls, each of the four walls including a marking of one of each euchre trump suit. The device further including a pair of end caps, each end cap having an inner face and an outer face. The inner face including means for displaying a score mounted thereon. Each end cap further including means for removably mounting the end cap to the body whereby the score displaying means is hidden by the body and the outer face.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views; and in which.

DETAILED DESCRIPTION OF THE INVENTION

Figure 1:
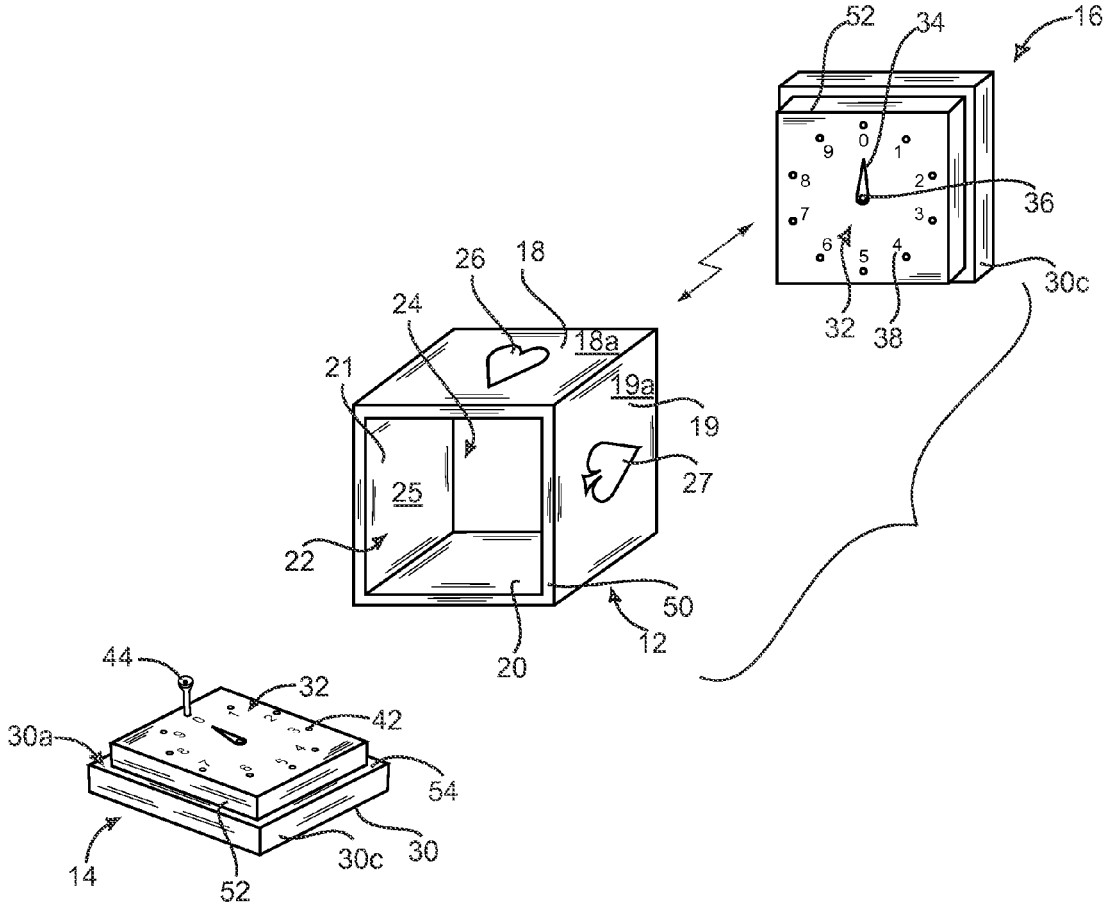
FIG. 1 is a perspective view of the euchre score and trump identifier embodying the invention.
Figure 2:
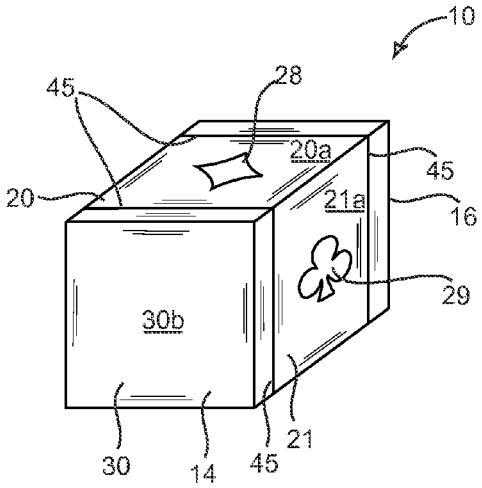
FIG. 2 is a perspective view of the cube showing the remaining trump indicating sides.
Figure 3:
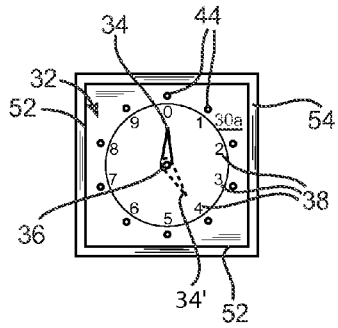
FIG. 3 is a front view of one of the scoring indicator end caps.

Referring now to FIGS. 1-3, a euchre score and trump indicating device 10 is shown and includes a body 12 and pair of end caps 14, 16. As will be discussed in greater detail below, the body 12 provides a visual aid for displaying the current trump in a hand of euchre, while the end caps 14, 16 provide a pair of counters for tracking or registering each team's score.

Body 12 is preferably shaped as a generally cube-shaped tube having four flat walls 18, 19, 20, and 21 and two opposing open ends 22, 24. Each of the outer surfaces 18*a*-21*a* of walls 18-21 prominently displays one of the four card trump suits, i.e., a heart 26, spade 27, diamond 28, and club 29. The suit markings 26-29 are applied to the walls 18-21 in a conventional manner, such as painting, adhesive labels, and/or etching.

Walls 18-21 cooperate to define a central passage or chamber 25 that is accessible through openings in ends 22, 24. In one embodiment, walls 18-21 are sized such that chamber 25 accommodates a deck of playing cards. As will be discussed in greater detail below, each end 22, 24 includes means to mount the two end caps 14, 16 to the body 12.

The two end caps 14, 16 are preferably identical in configuration and any discussion of an element or feature of one end cap can be generally considered applicable to the other end cap. The end caps 14, 16 have a flat and square bottom or wall 30. Bottom 30 is preferably the same size as the combined walls 18-21, whereby each side of bottom 30 matches the four sides of ends 22, 24 in size and shape.

An inner face or surface 30*a* of the end cap includes a euchre scoring indicator 32. Indicator 32 preferably includes a pointer arm 34 pivotally mounted to a post or axle 36. Indicator 32 includes a plurality of markings 38 that radially surround post 36. These markings 38 preferably display the numerals zero to nine. The markings 38 are disposed relative to post 36 and pointer 34 to permit a user to quickly rotate the pointer 34 to point at the marking equal to the current score for his euchre team.

It should be appreciated that other scoring indicator 32 configurations and types can be readily adapted to be mounted to end cap inner surface 30*a* and the present invention should not be strictly limited to the embodiments disclosed herein.

In one embodiment, each end cap 14, 16 may also include a second indicator or counter 40 that utilizes markings 38 to show the players the number of games won by a team. In the embodiment illustrated, ten apertures 42 are formed into scoring indicator 32. Each aperture 42 is radially aligned with one of the numbers zero-to-nine comprising markings 38. In this embodiment, a peg 44, sized to fit within apertures 42, is provided to allow a user to keep track of the number of games won by his team. In other embodiments, a second pointer arm 34', shown in phantom in FIG. 3, may be mounted to post 36 for the same purpose.

The end caps 14, 16 include mounting structures that are complementarily-shaped to and frictionally mate with the open ends 22, 24 of the body. In the embodiment illustrated in FIG. 1, body ends 22, 24 provide the female structure, while end caps 14, 16 providing the mating male structure, while in the embodiments illustrated in FIGS. 4 and 5, the reverse is true. It should be appreciated that in either configuration, the scoring indicator 32 is substantially enveloped within passage 25 and covered by the device's body when the end cap is placed in the stowed position. Further, the device has a relatively flat surface across the mating lines 45 between the caps and body when the end caps 14, 16 are placed in the stowed position (i.e., mounted to body 12).

Referring now to the embodiment illustrated in FIG. 1, body 12 is configured as a tube, having walls 18-21 cooperating to define two openings to internal passage 25 at the opposite ends 224, 24. The interconnected walls 18-21 terminate at both ends at substantially flat edges 50. In the embodiment illustrated, walls 18-21 present a substantially square cross-sectional shape.

Scoring indicator 32 on end caps 14, 16 has raised walls 52 extending from inner surface 30*a*. The walls 52 are offset from the outer edges 30*c* of wall 30 a distance that is approximately the same as the thickness of walls 18-21. In this manner, the wall's outer surfaces are sized to frictionally abut the body's inner wall surface to mate the end caps 14, 16 to body 12. The offset of walls 52 from edges 30*c* forms a shoulder 54 which abuts the body edges 50 when the end caps 14, 16 are placed in the stowed position.

Figure 4:
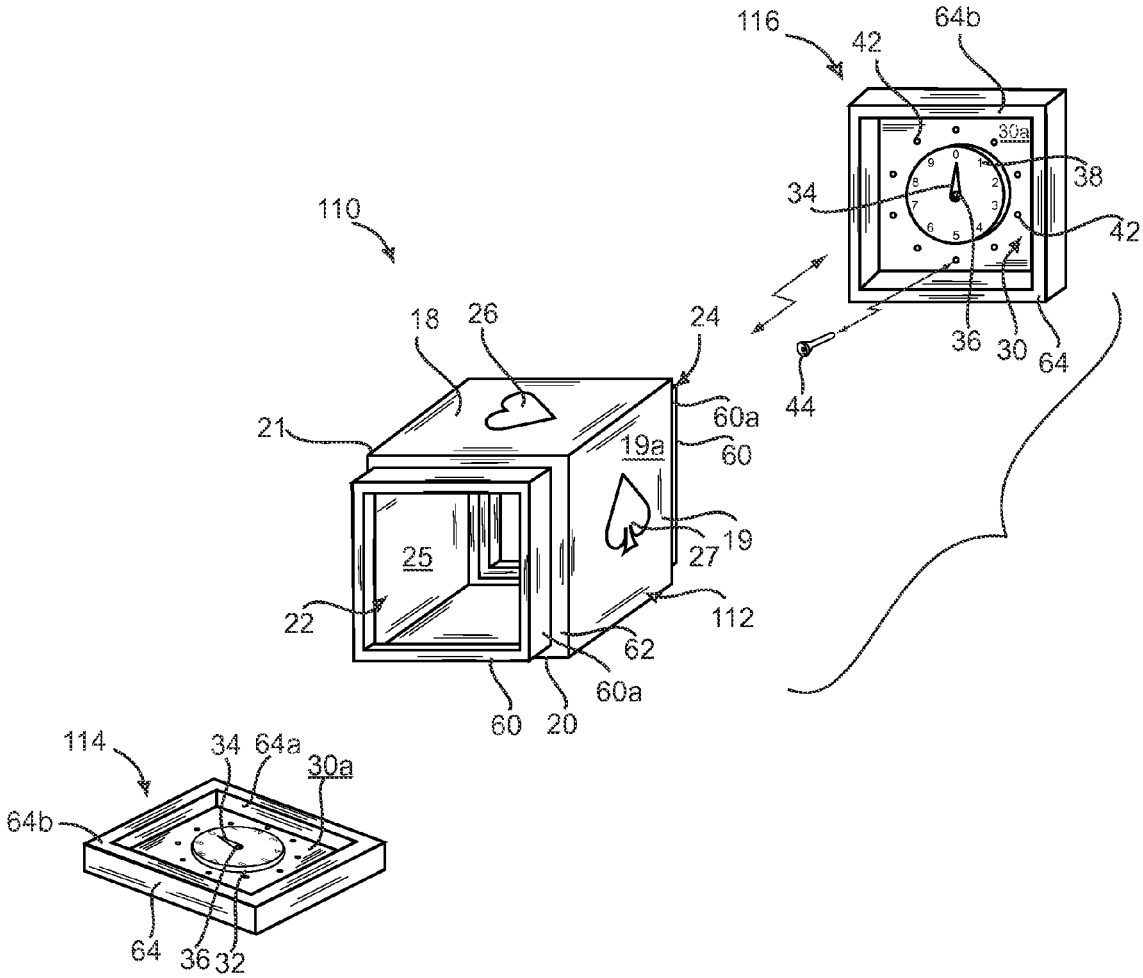
FIG. 4 is perspective view of an alternate end cap and body embodiment of the invention.

Referring now to the embodiment illustrated in FIG. 4, the device, denoted 110, is shown having a body 112, and end caps 114, 116, which are substantially the same as body 12, and end caps 14, 16 except for the means in which the end caps are mounted to the body. In this embodiment, body ends 22, 24 each include a raised annular wall or lip 60 that surrounds the respective openings in ends 22, 24. Lip 60 is offset from the four outer surfaces 18*a*-21*a* leaving a peripheral shoulder 62. In this embodiment, end caps 114, 116 have raised annular walls 64 extending from the outer periphery of inner surface 30*a*. The walls 64 are sized such that their inner surfaces 64*a* frictionally abut the lip's outer surfaces 60*a*, when the end caps 114, 116 are mated to the body 112. The uppermost wall surfaces 64*b* further abut shoulder 62 when placed in this mated or stowed position.

Figure 5:
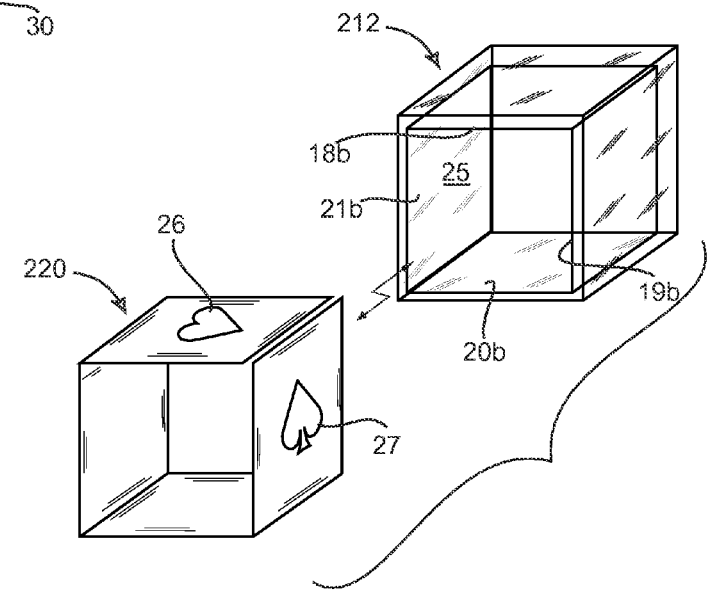
FIG. 5 is a partially exploded perspective view of an alternate embodiment illustrating a transparent body and interior mounted trump markings.

In another embodiment, shown in FIG. 5, the body, denoted 212, is substantially the same as body 112, but is formed from a clear material, such as acrylic, such that body walls 18-21 are substantially transparent. In this embodiment, the markings 26-29 can not only be applied to the outer surfaces, but can be applied to the inner surfaces 18*b*-21*b* of the tubular body 112 facing out through the body walls. In the embodiment shown, markings 26-29 are printed upon a contiguous sheet 220 of paper-like material, which is folded to conform to the shape of the opening 25.

It should be appreciated that in all of the above-described embodiments of the present invention, the outer surface 30*b* and edges 30*c* of bottom 30 are substantially flat, such that when the device 10 is in the stowed position illustrated in FIG. 2, the body outer surfaces 18*a*-21*a*, the bottom outer surfaces 30*b*, and edges 30*c* cooperate to define a substantially smooth and uniformly-shaped cube or rectangle.

Figure 6:
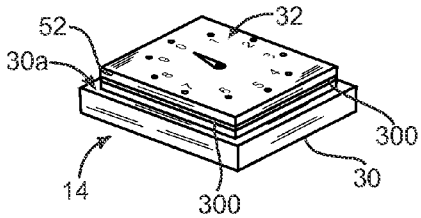
FIG. 6 is a perspective view of an alternate end cap having additional frictional fit ridges.

It should be appreciated that the frictional fit of the end caps to the body can be readily supplemented with additional means for retaining the end caps in the stowed position. That is, the frictional mating of the end caps to body may be supplemented with or replaced by other conventional interconnection structures or techniques, such as, but not limited to a radially outwardly projecting peripheral ridge 300 (shown in FIG. 6) along the outer wall 52 of an end cap 14, 16 increases the frictional fit between the mated components by wedging between the abutting surfaces. Other interconnection structures or techniques include: mating threaded structures; latches; hook and loop fasteners; and complementary studs and recesses (e.g., LEGO® bricks).

From the foregoing description, one skilled in the art will readily recognize that the present invention is directed to a combination euchre score and trump indicator. While the present invention has been described with particular reference to various preferred embodiments, one skilled in the art will recognize from the foregoing discussion and accompanying drawings that changes, modifications, and variations can be made in the present invention without departing from the spirit and scope thereof.

The invention claimed is:

1. A combination euchre score and trump indicating device, comprising:

a tubular body having four body walls which cooperate to define an internal cavity; and a pair of end caps, each end cap having an inner face and an outer face, the inner face including means for displaying a score mounted thereon, each end cap further including means for removably mounting the end cap to the body whereby the score displaying means is hidden by the body and the outer face.

2. A combination euchre score and trump indicating device as defined in claim 1, wherein each of the four walls includes a marking of one of each euchre trump suit.

3. A combination euchre score and trump indicating device as defined in claim 2, wherein the body walls and end caps cooperate to fully enclose said internal cavity when the end caps are mounted to the body in a stowed position.

4. A combination euchre score and trump indicating device as defined in claim 3, wherein said internal cavity is sized to receive a deck of euchre playing cards.

5. A combination euchre score and trump indicating device as defined in claim 1, wherein each of said end caps includes a raised wall extending from the inner face, the raised wall being slidably mated with said body.

6. A combination euchre score and trump indicating device as defined in claim 5, wherein said raised wall is received within the internal cavity.

7. A combination euchre score and trump indicating device as defined in claim 6, wherein said raised wall has a radially outer-most peripheral wall face, said peripheral wall face frictionally mating with an inner face of said body walls.

8. A combination euchre score and trump indicating device comprising:

a body having a continuous tubular wall defining an internal passage with openings at opposite ends of said body; and a pair of score indicators which are removably mounted to said body;

wherein when said score indicators are mounted to said body, said score indicators and said tubular wall cooperate to fully enclose said internal passage.

9. A combination euchre score and trump indicating device as defined in claim 8, wherein said tubular wall includes markings of each euchre trump suit approximately ninety degrees apart about a longitudinal axis of the internal passage.

10. A combination euchre score and trump indicating device as defined in claim 9, wherein said continuous tubular wall has a square cross-sectional shape.

11. A combination euchre score and trump indicating device as defined in claim 8, wherein said tubular wall has a certain peripheral shape at said openings and wherein said score indicators each further comprise:

a base plate having an outer peripheral profile matching said peripheral shape; and means for tracking a euchre game score mounted to said base plate such that said score tracking means is contained within said internal passage when said score indicator is mounted to said body.

12. A combination euchre score and trump indicating device as defined in claim 11, wherein said fully enclosed internal passage is sized to receive a deck of euchre playing cards.

13. A combination euchre score and trump indicating device as defined in claim 8, wherein each of said scoring indicators includes an inner surface and an outer surface, said scoring indicator including a raised peripheral wall which projects outwardly from said inner surface and slidably mates with said body.

14. A combination euchre score and trump indicating device comprising:

a body having a continuous tubular wall defining an internal passage with openings at opposite ends of said body; and a pair of score indicators which are removably mounted to said body, each score indicator has an inner face and an outer face and including means for tracking a euchre game score mounted to said inner face;

wherein when said score indicators are mounted to said body, said score tracking means is disposed within internal passage.

15. A combination euchre score and trump indicating device as defined in claim 14, wherein when said score indicators are mounted to said body, said score indicators and said tubular wall cooperate to fully enclose said internal passage.

16. A combination euchre score and trump indicating device as defined in claim 14, wherein said tubular wall includes markings of each euchre trump suit approximately ninety degrees apart about a longitudinal axis of the internal passage.

* * * * *